United States Patent [19]

Sioman

[11] 4,083,552

[45] Apr. 11, 1978

[54] FOLDER AND STACKER FOR TOWELS, OR OTHER ARTICLES

[75] Inventor: Carl F. Sioman, San Marino, Calif.

[73] Assignee: Team Industries, Los Angeles, Calif.

[21] Appl. No.: 762,290

[22] Filed: Feb. 25, 1977

[51] Int. Cl.[2] ..... B65H 45/18

[52] U.S. Cl. ..... 270/85; 214/6 DK

[58] Field of Search ..... 270/66–67, 270/82, 85; 214/6 D, 6 DK, 6 H; 101/136, 237–241; 271/189, 188, 192

[56] References Cited

U.S. PATENT DOCUMENTS

| | | | |
|---|---|---|---|
| 3,003,541 | 10/1961 | Prentice | 214/6 DK |
| 3,774,903 | 11/1973 | Sjoman | 270/67 |

*Primary Examiner*—Ernest T. Wright, Jr.
*Assistant Examiner*—A. Heinz
*Attorney, Agent, or Firm*—Harris, Kern, Wallen & Tinsley

[57] ABSTRACT

A folder and stacker for towels, or other articles, wherein the stacker includes an upwardly concave cradle for receiving a folded article and for providing the folded article with an upwardly concave, cross-sectional configuration, the cradle subsequently opening downwardly to permit the upwardly concave, folded article to drop by gravity onto a receiver therebeneath. Providing the folded article with an upwardly concave, cross-sectional configuration balances the air flows past the article on opposite sides thereof as it descends and thus insures that it will drop straight down under the influence of gravity, whereby a series of upwardly concave, folded articles dropped downwardly onto a receiver will be formed into a neat stack. The receiver may be a conveyor which is advanced one step as each stack is completed.

2 Claims, 3 Drawing Figures

FOLDER AND STACKER FOR TOWELS, OR OTHER ARTICLES

BACKGROUND OF INVENTION

The present invention relates in general to an apparatus for folding and stacking towels, or other articles, and, more particularly, to a stacker which drops a series of articles onto a receiver therebeneath to form a stack of such articles on the receiver. The latter may be a conveyor which is advanced one step upon completion of each stack.

OBJECTS AND SUMMARY OF THE INVENTION

The primary object of the present invention is to provide a stacker, and particularly a stacker for folded articles, which forms a neat stack on a receiver therebeneath, which receiver may be a conveyor advanced one step upon completion of each stack.

More particularly, an important object of the invention is to drop each article, in forming a stack, by first providing the article with an upwardly concave, cross-sectional configuration so that the air flows past the article on opposite sides thereof are balanced, whereby the article drops straight down onto a receiver, or onto an article therebeneath, so as to produce a neat stack of articles.

The invention may be summarized as including, and another important object of the invention is to provide a stacker which includes: two longitudinally extending, concave cradle structures pivotable downwardly from upper, generally horizontal, operative positions, wherein they project laterally inwardly toward each other and cooperate to form an upwardly concave, longitudinally extending cradle for receiving an article and for providing the article with an upwardly concave, cross-sectional configuration, to lower, downwardly dependent, inoperative positions wherein they are laterally spaced apart to release the article and permit same to drop by gravity with the article having the desired upwardly concave, cross-sectional configuration so as to balance the air flows past the article on opposite sides thereof so that the article drops straight down; a receiver for the article located below the cradle structures; and means for pivoting the cradle structures between their upper and lower positions.

The invention may be further summarized as including cradle structures which comprise, and an additional object is to provide cradle structures which comprise, spaced, parallel shafts respectively carrying concave fingers which are overlapped and interleaved to form the cradle when the cradle structures are in their upper, operative positions.

The foregoing objects, advantages, features and results of the present invention, together with various other objects, advantages, features and results thereof which will be evident to those skilled in the folding and stacking art in the light of this disclosure, may be achieved with the exemplary embodiment of the invention described in detail hereinafter and illustrated in the accompanying drawings.

DESCRIPTION OF EXEMPLARY EMBODIMENT OF INVENTION

Figure 1:
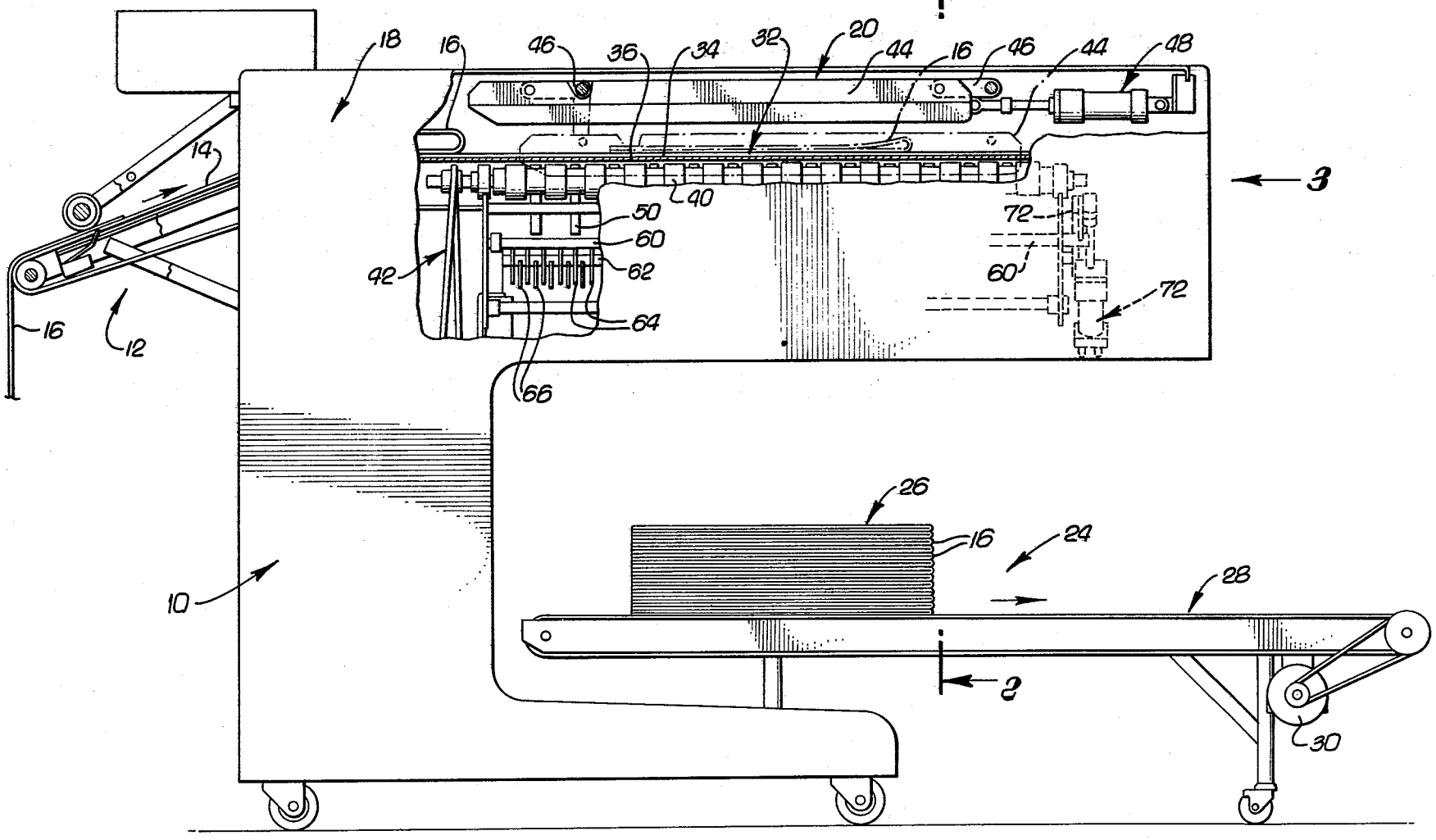
FIG. 1 is a side elevational view of a folder and stacker which embodies the invention, portions of a housing of the apparatus being broken away to reveal internal parts.
Figure 2:
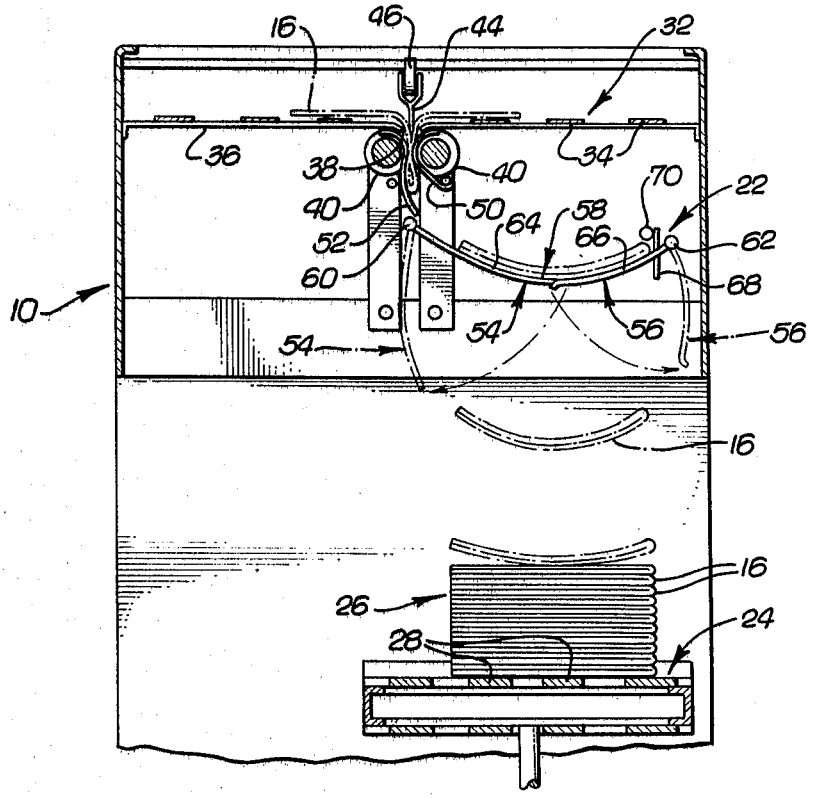
FIG. 2 is a fragmentary cross-sectional view taken as indicated by the arrowed line 2—2 of FIG. 1.

The folder and stacker of the invention is designated generally by the numeral 10 in FIG. 1 of the drawings, and includes an outlet end 12 provided with a feed conveyor 14 on which towels 16, or other articles to be folded and stacked, are placed in sequence. The apparatus 10 may be provided adjacent its inlet end, in the region designated by the numeral 18, with means, not shown, for cross folding each towel as it traverses such region. Each cross folded towel is then folded longitudinally, by a longitudinal folding means 20 to be described. As best shown in FIG. 2 of the drawings, the cross and longitudinally folded towel 16 is then delivered to a stacker or stacking apparatus 22 of the invention which provides the towel with an upwardly concave, cross-sectional configuration. Again as shown in FIG. 2, the stacker 22 subsequently drops the towel 16, with its upwardly concave, cross-sectional configuration, downwardly onto a receiver 24 to form a stack 26. Dropping each towel 16 with an upwardly concave, cross-sectional configuration balances the air flows past the towel on opposite sides thereof as it descends and thus insures that the same will drop straight down onto the receiver 24, or onto a previously dropped towel, to form a neat stack 26 wherein all the towels are vertically aligned. The receiver 24 may comprise a conveyor 28 driven by a motor 30 in a step-by-step manner, with the conveyor 28 being advanced one step upon completion of each stack 26.

Considering the manner in which each cross folded towel 16 is folded longituinally by the longitudinal folding means 20, the cross folded towel is transported longitudinally of the apparatus 10 by a conveyor 32 which includes a plurality of longitudinally extending, laterally spaced belts 34 the upper runs of which ride on longitudinally extending plates 36 which are spaced apart laterally to provide a central, longitudinal slot 38. As best shown in FIG. 2, below the plates 36 and on opposite sides of the slot 38 are counterrotating, longitudinally discontinuous, rolls 40. These rolls are driven in opposite dirctions, by a drive means 42, FIG. 1, in directions such that the peripheries of the rolls move downwardly as they approach each other.

Figure 3:
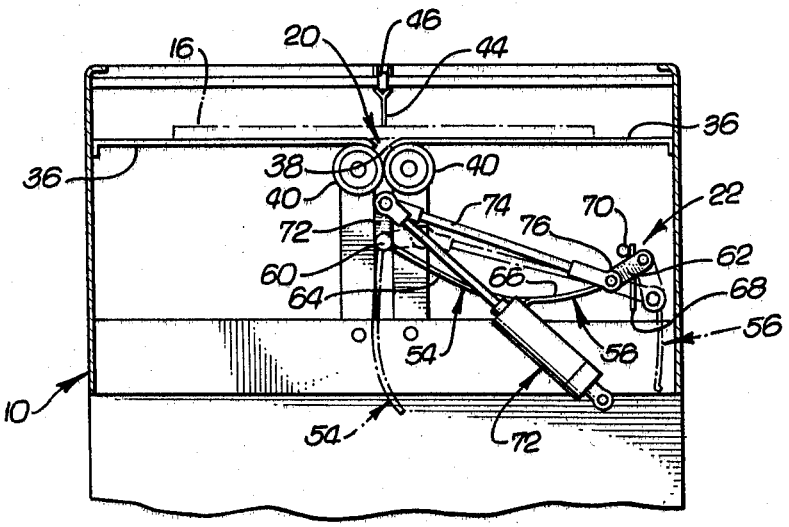
FIG. 3 is a view taken generally as indicated by the arrow 3 of FIG. 1, with a portion of the housing being shown in section to reveal internal parts.

Above the longitudinally extending slot 38 is a longitudinally extending blade 44 which is movable between an upper, retracted position, shown in solid lines in FIG. 1 and shown in FIG. 3, and a lower, extended position, shown in broken lines in FIG. 1 and shown in FIG. 2. To achieve this motion, the blade 44 is carried by pivoted arms 46 which permit the blade to be swung downwardly from its upper position to its lower position, and upwardly from its lower position to its upper position. Such displacement of the blade 44 between its upper and lower positions is accomplished by an air cylinder 48, FIG. 1, connected to one end of the blade.

When the blade 44 is displaced downwardly into its lower position, it passes through the slot 38 and enters the space between the rolls 40 to displace a central longitudinal portion of a towel 16 therebeneath downwardly through the slot 38 and into the space between the rolls 40 to form a central longitudinal fold in the towel.

The counterrotating rolls 40 propel the central longitudinal fold in the towel 16 downwardly between laterally spaced sets of longitudinally spaced guide fingers 50 and 52 located in the discontinuities in the rolls 40, as shown in FIG. 2. The two sets of fingers 50 and 52 guide the longitudinally folded towel 16 to the stacker 22, one such towel being shown in position on the stacker 22 in FIG. 2 of the drawings.

The stacker 22, as best shown in FIG. 2, comprises two longitudinally extending, concave cradle structures 54 and 56 pivotable downwardly from upper, generally horizontal, operative positions, shown in solid lines in FIGS. 2 and 3, wherein they project laterally inwardly toward each other and cooperate to form an upwardly concave, longitudinally extending cradle 58 for receiving a longitudinally folded towel 16 and for providing such towel with an upwardly concave, cross-sectional configuration, as shown in FIG. 2, to lower, downwardly dependent, inoperative positions, shown in broken lines in FIGS. 2 and 3, wherein they are laterally spaced apart to release the towel and permit same to drop straight down by gravity, as shown in FIG. 2, with the towel having the desired upwardly concave, cross-sectional configuration. Such towel drops straight down either onto the receiver 24, or onto a towel therebeneath, so as to produce the stack 26. An important feature of the invention is that the upwardly concave, cross-sectional configuration imparted to each towel 16 as it is dropped balances the air flows past the towel on opposite sides of the longitudinal center thereof and thus insures that it will drop down onto the receiver 24, or onto a previously dropped towel therebeneath, to form a neat stack, wherein all of the towels are properly aligned vertically.

The two cradle structures 54 and 56 respectively comprise laterally spaced, parallel, longitudinally extending shafts 60 and 62 which are suitably pivotally mounted on the framework of the apparatus 10. The cradle structure 54 compriss longitudinally spaced, upwardly concave fingers 64 carried by the pivoted shaft 60, and the cradle structure 56 comprises longitudinally spaced, upwardly concave fingers 66 carried by the pivoted shaft 62. When the two cradle structures 54 and 56 are in their upper, generally horizontal, operative positions, the two sets of fingers 64 and 66 are overlapped and interleaved to form the upwardly concave, longitudinally extending cradle 58, which cradle provides each longitudinally folded towel 16 with the desired upwardly concave, cross-sectional configuration to balance the air flows past opposite sides of the towel as it descends and thus insure that it will drop straight down when the cradle structures are pivoted into their lower, downwardly dependent, inoperative positions.

As best shown in FIG. 2, to insure that each longitudinally folded towel 16 will be centered properly on the upwardly concave, longitudinally extending cradle 58, lateral motion of such towel from the longitudinal folding means 20 is limited by engagement of the longitudinal fold therein with stationary, longitudinally spaced stop fingers 68 interleaved with the fingers 66 of the cradle structure 56. The stop fingers 68 are carried by a suitable stationary support 70 which extends longitudinally of the apparatus 10.

Considering the manner in which the cradle structures 54 and 56 are pivoted between their upper, operative positions and their lower, inoperative positions, and referring particularly to FIG. 3, the shaft 60 is provided with a radial arm 70 to which is connected one end of an air cylinder 72, the other end being suitably anchored pivotally to the framework of the machine 10. As will be apparent, as the air cylinder 72 is contracted, it pivots the arm 70 in the clockwise direction, FIG. 3, to lower the cradle structure 54. The arm 70 also has pivotally connected thereto one end of a link 74 the other end of which is pivotally connected to a similar radial arm 76 on the shaft 62. As the air cylinder 72 is shortened, it acts through the link 74 and the arm 76 to pivot the cradle structure 56 downwardly into its inoperative position. Of course, lengthening of the air cylinder 72 pivots the cradle structures 54 and 56 upwardly into their upper, operative positions.

Although an exemplary embodiment of the invention has been disclosed herein for illustrative purposes, it will be understood that various changes, modifications and substitutions may be incorporated in such embodiment without departing from the invention as hereinafter claimed.

I claim as my invention:

1. In an apparatus for stacking articles delivered thereto in sequence, the combination of:

(a) two longitudinally extending, concave cradle structures pivotable downwardly from upper, generally horizontal, operative positions, wherein they project laterally inwardly toward each other and cooperate to form an upwardly concave longitudinally extending cradle for receiving an article and for rendering the article upwardly concave in cross section, to lower, downwardly dependent, inoperative positions wherein they are laterally spaced apart to release the article and permit same to drop by gravity, with the article upwardly concave in cross section, whereby forces produced by the air flowing past the article on opposite sides thereof as it descends, and acting on the article, are balanced so as to insure that the article will drop straight down;

(b) a receiver for the article located below said cradle structures; and (c) means for pivoting said cradle structures between their upper and lower positions.

2. An apparatus according to claim 1 wherein said cradle structures comprise laterally spaced, parallel, longitudinally extending shafts respectively carrying concave fingers which are overlapped and interleaved to form said cradle when said cradle structures are in their upper positions.

* * * * *